United States Patent [19]

Jones

[11] Patent Number: 5,050,873

[45] Date of Patent: Sep. 24, 1991

[54] PULLDOWN EXERCISE MACHINE

[75] Inventor: Gary A. Jones, Falmouth, Ky.

[73] Assignee: Hammer Corporation, Ky.

[21] Appl. No.: 514,869

[22] Filed: Apr. 26, 1990

[51] Int. Cl.[5] ..... A63B 21/00; A63B 21/22

[52] U.S. Cl. ..... 272/134; 272/117

[58] Field of Search ..... 272/134, 118, 117, 116, 272/72, 73, 144, DIG. 4, 123

[56] References Cited

U.S. PATENT DOCUMENTS

| | | | |
|---|---|---|---|
| 3,858,873 | 1/1975 | Jones . | |
| 3,998,454 | 12/1976 | Jones | 272/117 |
| 3,998,455 | 12/1976 | Jones . | |
| 4,720,099 | 1/1988 | Carlson | 272/134 |

OTHER PUBLICATIONS

Brochure entitled, "Nautilus Midwest".

*Primary Examiner*—Richard J. Apley

*Assistant Examiner*—Jerome W. Donnelly

*Attorney, Agent, or Firm*—Wood, Herron & Evans

[57] ABSTRACT

A pulldown exercise machine for exercise of a muscle group that includes the forearm flexors, the biceps and the latissimus dorsi includes a frame, a seat connected to the frame and two independently maneuverable levers that are pivotally connected to the frame behind and above the seat. The rearward end of each of the levers is adapted to hold a removable weight while the forward end includes an angled handle adapted to be grasped and pulled in a downward direction by a person supported on the seat. The orientation of the sides of the frame, the levers and the handles with respect to the seat insures that pivotal movement of the levers occurs along vertical planes that diverge outwardly from the front of the seat, thereby providing a pulldown exercise that more naturally accommodates the musculoskeletal movements of a person.

15 Claims, 4 Drawing Sheets

PULLDOWN EXERCISE MACHINE

FIELD OF THE INVENTION

This invention relates to an improved pulldown exercise machine that accommodates the musculoskeletal makeup of a person.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

On one hand, free weights offer a number of advantages over exercise machines. For one, they are relatively inexpensive in comparison. Free weights are also more versatile because a variety of exercises can be performed with one set of weights, whereas most exercise machines are designed for only one exercise. For those exercise machines which do provide for more than one exercise, cost usually increases proportionately with the number of exercises. Finally, free weights are popular among many weight lifters because the lifting movements are not restricted to prescribed planes of motion and at prescribed angles.

However, there are a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998,454 with respect to a commonly performed exercise referred to as the bicep curl, as performed with a dumbbell. In short, the applied moment arm about the elbow varies according to the sine of the angle of the lower arm with respect to the vertically oriented upper arm. The moment arm is greatest when the angle is 90°, and it is lowest near 180° and 0°.

If the resistance capabilities of the muscles of the human body matched this moment arm, the degree of difficulty experienced by the exerciser would be uniform, or balanced, throughout this range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a bicep curl with a dumbbell.

A pullover machine disclosed in U.S. Pat. No. 3,998,454 utilizes an eccentric cam to vary weight resistance for the muscles through a range of motion utilized in a pullover. Over the years, for various muscle groups, a number of these cam and chain machines have attempted to match resistance variation through a range of motion with the natural strength curve associated with the human body for those particular muscle groups. To the extent that these machines come close in approximating the designed resistance variation to the actual human strength curve, an improvement over lifting of free weights has been achieved.

However, machines of this type suffer from a number of practical disadvantages. For instance, the chains and cams of these machines are susceptible to rust and debris buildup which increases the total amount of resistance against movement of the limb during exercise. Moreover, some of the cam and chain machines employ resistance in the form of permanently connected weight plates that move along a rigid guide. This guide is also susceptible to rust or debris buildup. In order to maintain optimum conditions for these machines, the chains, cams and guides must be lubricated regularly.

In addition to the practical disadvantages associated with maintenance and/or maintenance costs, another disadvantage relates to the fact that such machines do not permit the degree of freedom of movement that is possible when lifting free weights. For example, for the pullover machine of U.S. Pat. No. 3,998,454, upper body movement is restricted along two parallel, rigidly connected planes, with shoulder pivot about vertically fixed positions. Many exercisers complain that this machine or others like it are simply too confining with respect to the possible freedom of movement for the muscles that are exercised, almost to the point of discomfort.

One attempt to solve this problem involves the use of machines that employ weighted levers. A pulldown machine has been designed that utilizes a double handled lever pivotably connected to a frame. This machine provides exercise through a pulldown maneuver that permits more degrees of freedom of movement than the pullover machine disclosed in U.S. Pat. No. 3,998,454.

Unfortunately, even this lever-type pulldown machine suffers from a subtle disadvantage that most weight lifters apparently have assumed to be inherent with all exercise machines. That is, the planes or angles of prescribed movement do not seem quite right in relation to the musculoskeletal structure of a normal person. In short, this machine and others like it do not seem to "fit" the human body, or simply, they do not feel right. Moreover, some individuals have complained that excessive joint stress may result from use of these machines.

One explanation for this problem is derived from a theory that is based upon accumulated years of observing and analyzing athletic movements of the body in comparison to weight lifting movements. Proponents of this theory point out that most musculoskeletal movements are rather complex and involve multiple joints and multiple degrees of freedom, while most exercise machines are designed to mimic simple movements that are either directed at right angles or parallel to the body. In a sense, most exercise machines oversimplify the musculoskeletal movements of the human body, and there is room for improvement in the design of exercise machines, particularly when considering that the ultimate objective is to obtain maximum muscular benefit with minimum joint stress.

Finally, although prior pulldown or pullover machines known by the inventor may be used to exercise one arm at a time, they have not been designed specifically for that purpose. As a result, performance of one-handed exercise on such machines may even further accentuate the awkwardness that is felt. This significantly limits the practical uses of such machines for the purpose of rehabilitation, where it is often desirable to monitor the relative strength of a previously injured, recovering limb with a healthy limb.

It is therefore an object of the invention to provide an improved pulldown exercise machine that more naturally accommodates the musculoskeletal movements of a person's body.

It is another object of the invention to provide an improved pulldown exercise machine that maximizes the exercise benefit attainable during a pulldown maneuver while minimizing skeletal or joint stress.

It is still another object of the invention to provide an improved pulldown exercise machine with increased versatility in exercising one arm at a time.

SUMMARY OF THE INVENTION

This invention contemplates a pulldown exercise machine having a frame that pivotally supports two levers with forward ends adapted to be grasped and pulled downwardly, either independently or simultaneously, to raise the weighted rearward ends, with the pulldown movements oriented in a manner that accommodates the natural musculoskeletal structure of the human body.

The frame has sides that diverge outwardly from the front of the machine, and the levers are moved through correspondingly diverging planes. Moreover, the location of the non-aligned pivot axes, the lengths and starting angles of the forward ends of the levers, and the angles of the handles attached to the forward ends combine to provide a machine that, based upon feedback from a number of individuals involved in the field of strength training, more naturally accommodates the musculoskeletal movements of a human being.

By providing two independently operable levers that are designed to match the natural movement of muscles of one side with respect to the entire body, this improved pulldown machine is particularly suitable for rehabilitation after an injury.

In accordance with the objects of this invention, a pulldown exercise machine preferably includes a frame, a seat connected to the frame, the frame having two vertically upright sides that diverge outwardly from the front of the seat and two levers, each lever pivotally connected to one of the outwardly diverging sides and having an angled handle located at a forward end in front of the seat and a weight supporting hub connected to a rearward end located behind the seat. The lever pivot axes are located above and behind the seat and are perpendicular to their respective sides of the frame. When the handles are grasped and pulled in a downward direction, the arcuate paths traversed by the handles and the levers are along vertical planes that diverge outwardly from a vertical midplane that bisects the seat. The angled orientation of the levers and the handles with respect to the forward facing direction of the seat provides a natural grasping position for coupling the applied pulldown force to two diverging vertical planes of motion that seem to more naturally accommodate the structure of the human body relative to this maneuver. As a result, a person supported on the seat is able to maximize the muscular benefits attainable with a pulldown or pullover motion. This invention exercises a muscle group that includes the forearm flexors, the biceps and the latissimus dorsi. Moreover, it does so in a manner that does not unnecessarily stress joints associated with this muscle group, such as the shoulder.

As noted above, due to the more natural orientation of the sides of the frame with respect to a human body, and the capability of working both arms independently, this pulldown machine constitutes an improvement over prior cam and chain pullover and lever-type pulldown machines. This invention provides the benefits of both free weights and weight machines without the attendant disadvantages commonly associated with these methods of exercising.

For this machine, the resistance variation through the pulldown movement is similar to the resistance variation provided by the prior lever type pulldown machine. However, it is not identical. The angles and lengths of the forward ends of the lever arms, the lengths and angles of the handles and the locations of the pivot axes with respect to the seat have been oriented to make it slightly easier to initiate pulldown, and slightly more difficult to continue movement once pulldown has been initiated, and then easier again at the end of the motion. This compensates for the initial acceleration that is required to commence the pulling force and the reduction in force caused by the momentum of a moving lever, and a terminal deceleration at the end of the movement.

These and other features of the invention will be more readily understood in view of the following detailed description and the drawings in which:

DETAILED DESCRIPTION OF THE DRAWINGS

Figure 1:
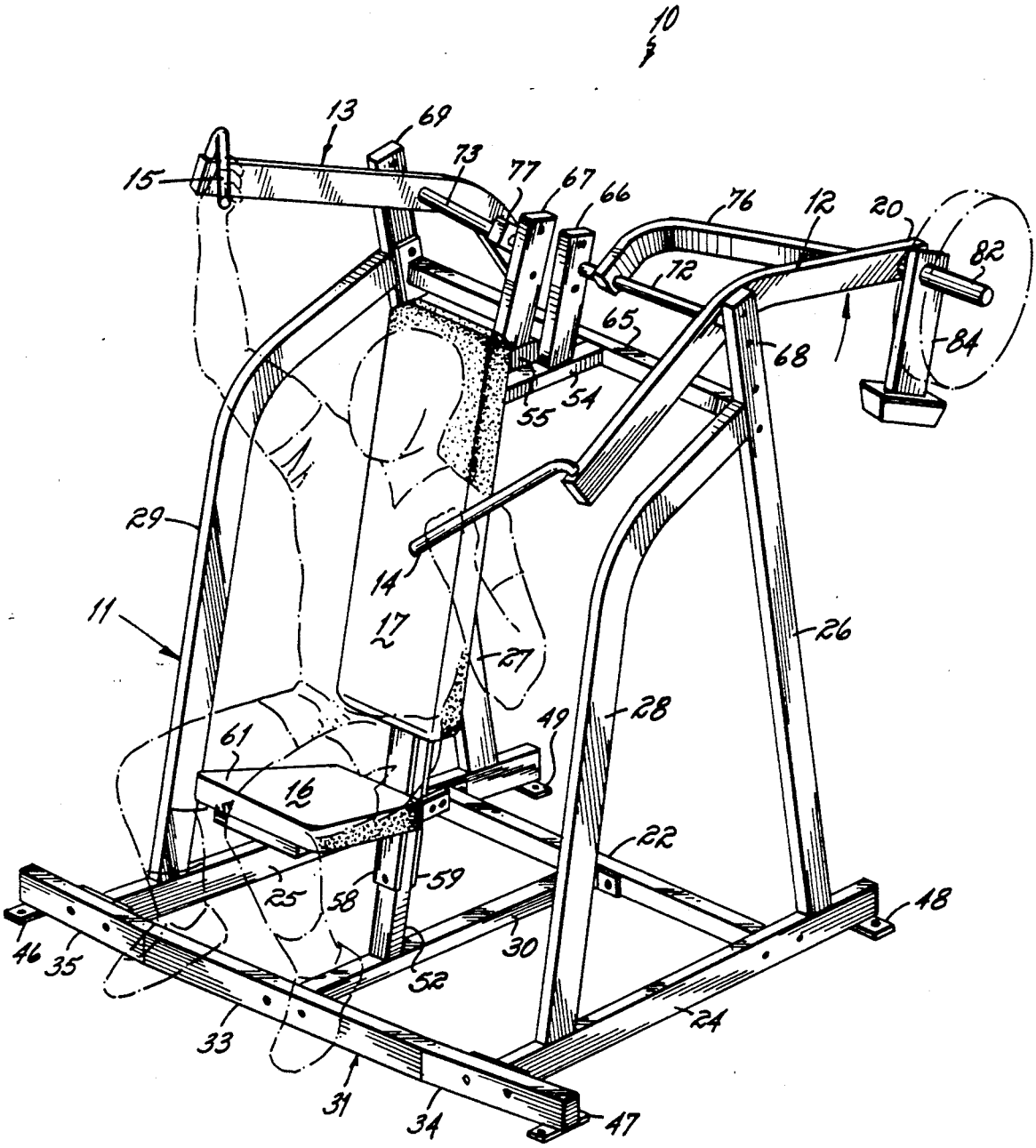
FIG. 1 is a perspective view of a pulldown exercise machine in accordance with a preferred embodiment of the invention.

FIGS. 1–4 show a pulldown exercise machine 10 in accordance with a preferred embodiment of the invention. This machine 10 includes a frame 11 made of a number of straight and curved sections of heavy duty steel that are either welded or bolted together, or pivotally connected. Exercise levers 12 and 13 are pivotally connected to the frame 11. Handles 14 and 15 are connected to the forward ends of levers 12 and 13, respectively. Handles 14 and 15 are located above a seat 16, and a back support 17. The seat 16 and back support 17 are bisected by a vertical midplane 18 (shown in FIG. 2) that extends through the middle of frame 11. The machine 10 is symmetrical with respect to midplane 18. When supported on the seat 16, a person reaches up and grasps handles 14 and 15. With a pulldown motion, either simultaneously with both arms or independently, in an asynchronous manner, the forward ends of the levers 12 and 13 may be moved downwardly against the weight resistance held by the rearward ends 20 and 21 of levers 12 and 13, respectively.

The frame 11 has two sides, each of which sides diverge outwardly from midplane 18 with respect to the forward direction of the machine 10, or to the direction that a person sitting on the seat 16 would face. Each side has a bottom support, a rear leg and a front leg. On the left side of the frame 11, as viewed by one seated on seat 16, these parts are numbered 24, 26 and 28, respectively. Similarly, on the right side of frame 11 these parts are numbered 25, 27 and 29, respectively. Front legs 28 and 29 bend rearwardly about ¾ of the way up. The metal sections forming the sides are preferably connected together by welds.

Figure 2:
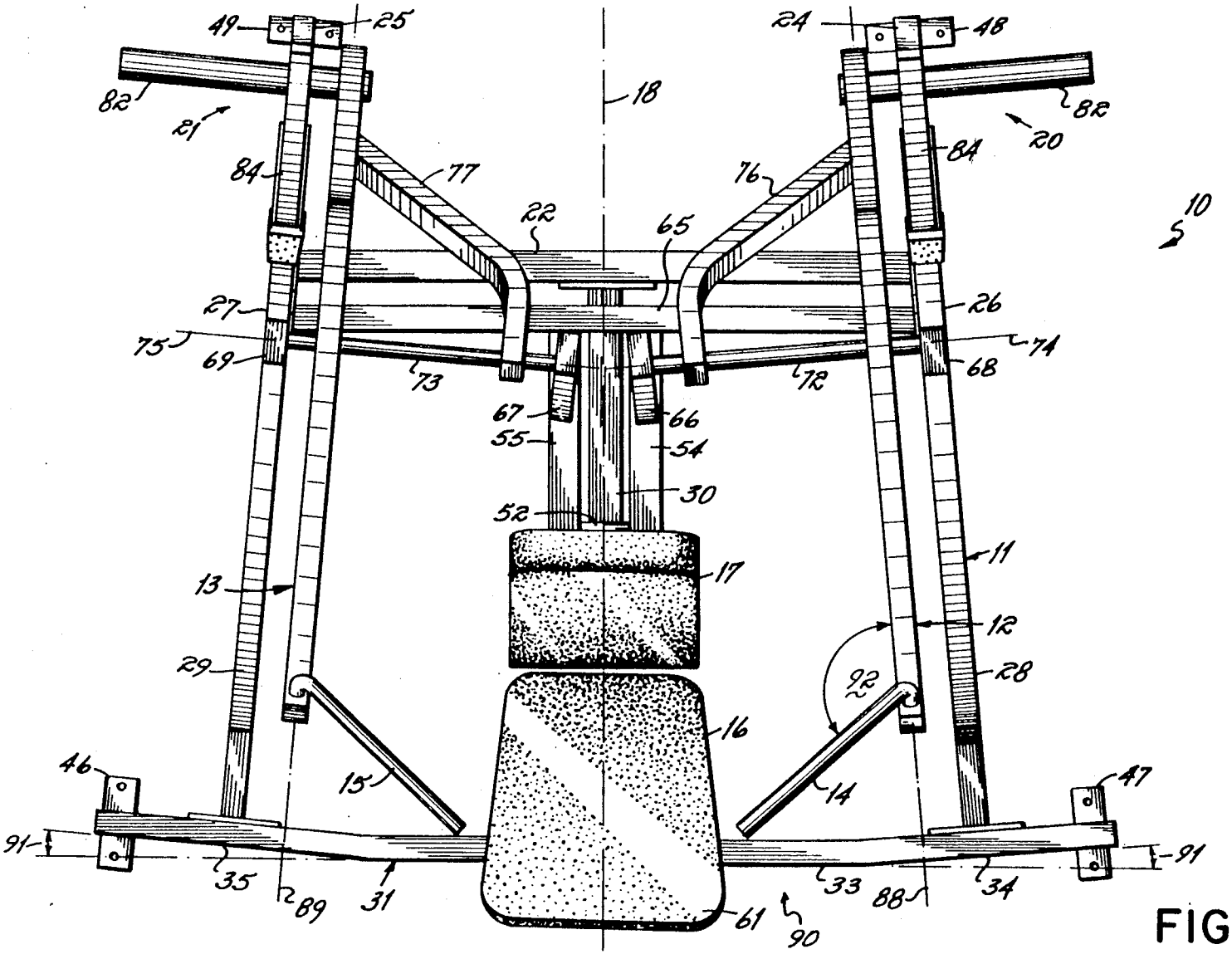
FIG. 2 is a top view of the pulldown exercise machine shown in FIG. 1.
Figure 3:
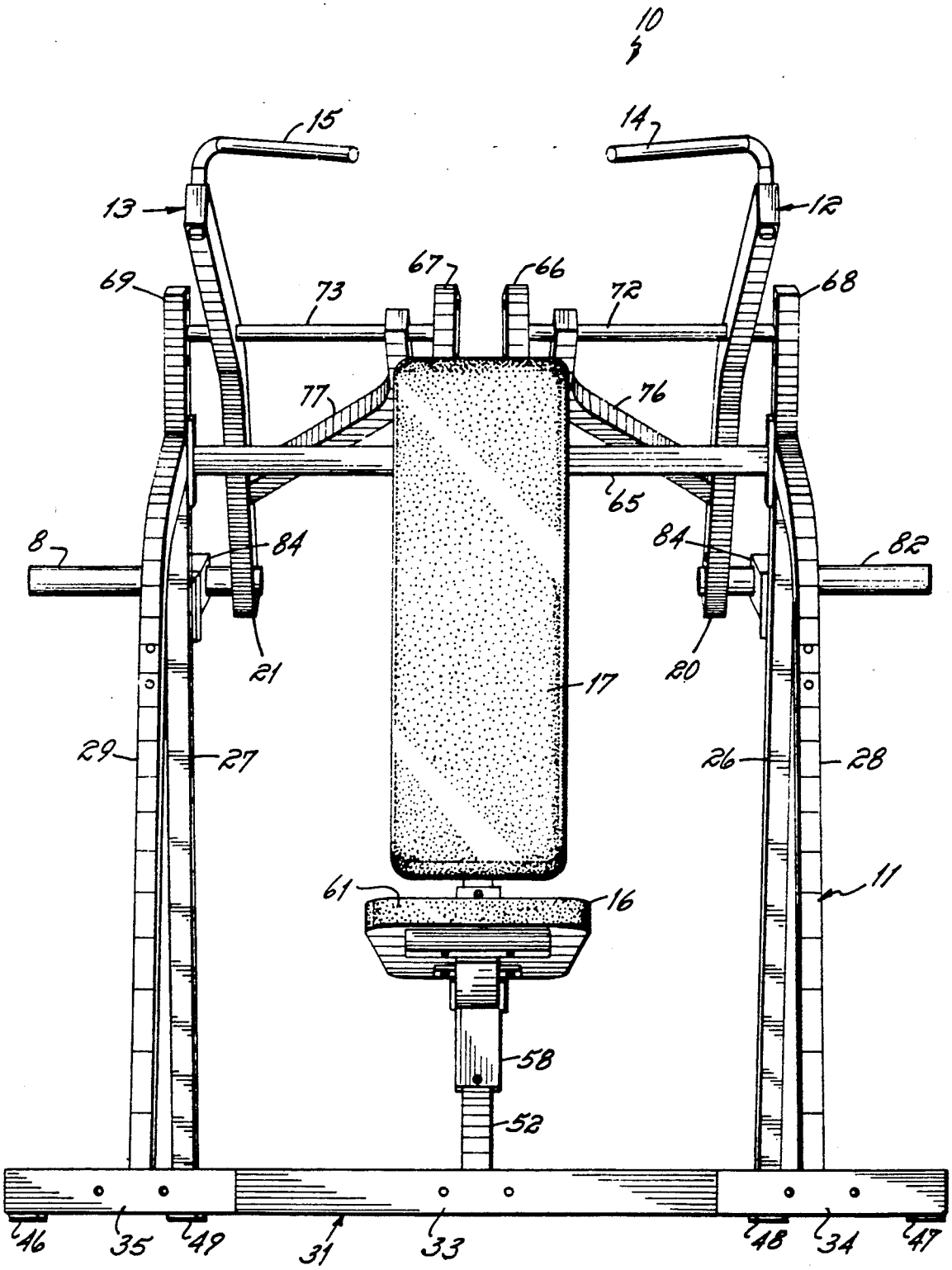
FIG. 3 is a front view of the pulldown exercise machine shown in FIG. 1.

At the bottom of the frame 11, the sides are connected by a base which includes a rear section 22, a mid section 30 and a front section 31. Front section 31 includes a central portion 33 that is parallel with rear section 22, and outer portions 34 and 35 that angle rearwardly to connect to bottom supports 24 and 25, respectively. The bottom side supports 24 and 25 both diverge outwardly with respect to the front of the machine 10, preferably at angles about 5° (FIG. 2). The forward ends of sections 24, 30 and 25 are connected to front section 31, preferably by bolts (not shown). The bolts pass through holes in end plates welded perpendicularly to the ends of the respective sections. Rear section 22 is also connected by bolts to the rear ends of bottom supports 24 and 25. The frame 11 may also include base supporting plates 46, 47, 48 and 49 which are welded to the bottom of frame 11 at the exterior four corners.

Seat 16 and back support 17 are connected to a central section 52 that is aligned along vertical midplane 18. Central section 52 is welded at its bottom end to middle section 30 and supported at its top end by braces 54 and 55. While the back support 17 is rigidly fixed to central section 52, seat 16 is preferably adjustable upwardly or downwardly. Adjustment is provided by frictional engagement between parallel spaced bars (not shown) connected to seat 16 and two planar pieces 58 and 59 that are secured to central section 52 in a sandwiching arrangement. To raise or lower the seat 16, its forward end 61 is tilted upwardly with respect to central section 52 so that the spaced parallel bars move away from, or provide clearance from pieces 58 and 59. In this orientation, the seat 16 may be moved upward or downward, parallel to section 52. When the forward end is subsequently tilted downwardly, the parallel bars of seat 16 will frictionally engage the pads. Any number of other methods for providing adjustability for seat 16 would be equally suitable.

Near the top of the frame 11, rearward ends of sections 54 and 55 are welded to a connecting brace 65. Preferably, brace 65 is bolted at its spaced ends to upper, interior facing sides of the rear legs 26 and 27. Uprights 66 and 67 are welded to section 54 and 55, respectively. These uprights 66 and 67 must be situated on sections 54 and 55, respectively, in such manner that accommodates the offset angle of the respective sides of the frame 11, this offset angle preferably being about 5°. Along with the uppermost ends, 68 and 69, of rear legs 26 and 27, respectively, uprights 66 and 67 define the locations for the axes of connection of levers 12 and 13, respectively.

Lever 12 includes an axle 72 aligned along an axis of connection 74, while lever 13 includes a axle 73 aligned along an axis of connection 75 as shown in FIG. 2. The axles are connected to frame 11 by bearings. A pillow block bearing sold by Browning, Part No. VF 2S 116 has proved suitable. These bearings require maintenance only once a year, which consists of one shot of lubricating oil. Both axis 74 and axis 75 are oriented perpendicular to their respective diverging exterior sides of the frame 11. Axes 74 and 75 are also both located behind and above seat 16. For additional strength and stability, levers 12 and 13 include stabilizing braces 76 and 77, respectively, which extend from interior positions of connection with the axle near the uprights to the respective rearward ends. Rearward end 20 of lever 12 includes an outwardly extending hub 82 for holding weighted plates, and an inwardly directed stop arm 84 that coacts with leg 26 to limit downward pivotal movement of rear end 20. Preferably, either rear leg 26 or section 84, or both, includes a rubber stopper to prevent metal to metal engagement. Similarly, lever 13 includes a rear end 21 to which hub 83 is welded, along with an inwardly directed stop arm 85.

FIG. 2 shows, from a top view, levers 12 and 13, and their respective axes 74 and 75. This view also clearly shows the divergence of the sides of frame from midplane 18, the sides being aligned along vertical planes 88 and 89. This view also shows angled side portions 34 and 35 bent rearwardly at angles of about 5° to accommodate the forward divergence of the sides of the frame 11. This view also shows that brace 65 and rear section 22 are of shorter side to side length than front section 31, in order to accommodate the divergence of the sides of the frame 11.

Handles 14 and 15 are connected at angles to their respective levers. Each handle angles forwardly at an angle of about 125°, designated by numeral 92, and downwardly at an angle of about 60°, designated by numeral 93, with respect to the lever. In other words, with respect to the levers, the handles are offset toward plane 18 by an angle of about 55°. With respect to the angle of orientation of the levers in a vertical plane, the handles are angled downwardly about 30°. The angles are shown most clearly in FIGS. 2 and 4. The angles of the handles couple natural grasping positions for the hands to the diverging planes, thereby enabling motive force to be applied through a pulldown motion in diverging planes that more naturally accommodate the musculoskeletal structure of a human being. Compared to the prior pullover exercise machine where the planes of movement were parallel with respect to a central vertical plane and shoulder pivot points were fixed in order to accommodate movement in these parallel planes, frame 11 enables a person to perform a pulldown exercise, either simultaneously with both arms or independently, in a manner which does not place unnecessary stress upon joints associated with this muscle group. Moreover, as a further advantage over that the cam and chain pullover machine and a lever type pulldown machine, this machine 10 not only accommodates more natural orientation of the body, but also permits natural pulldown exercise of one arm at a time, a feature that is particularly desirable for rehabilitation.

Figure 4:
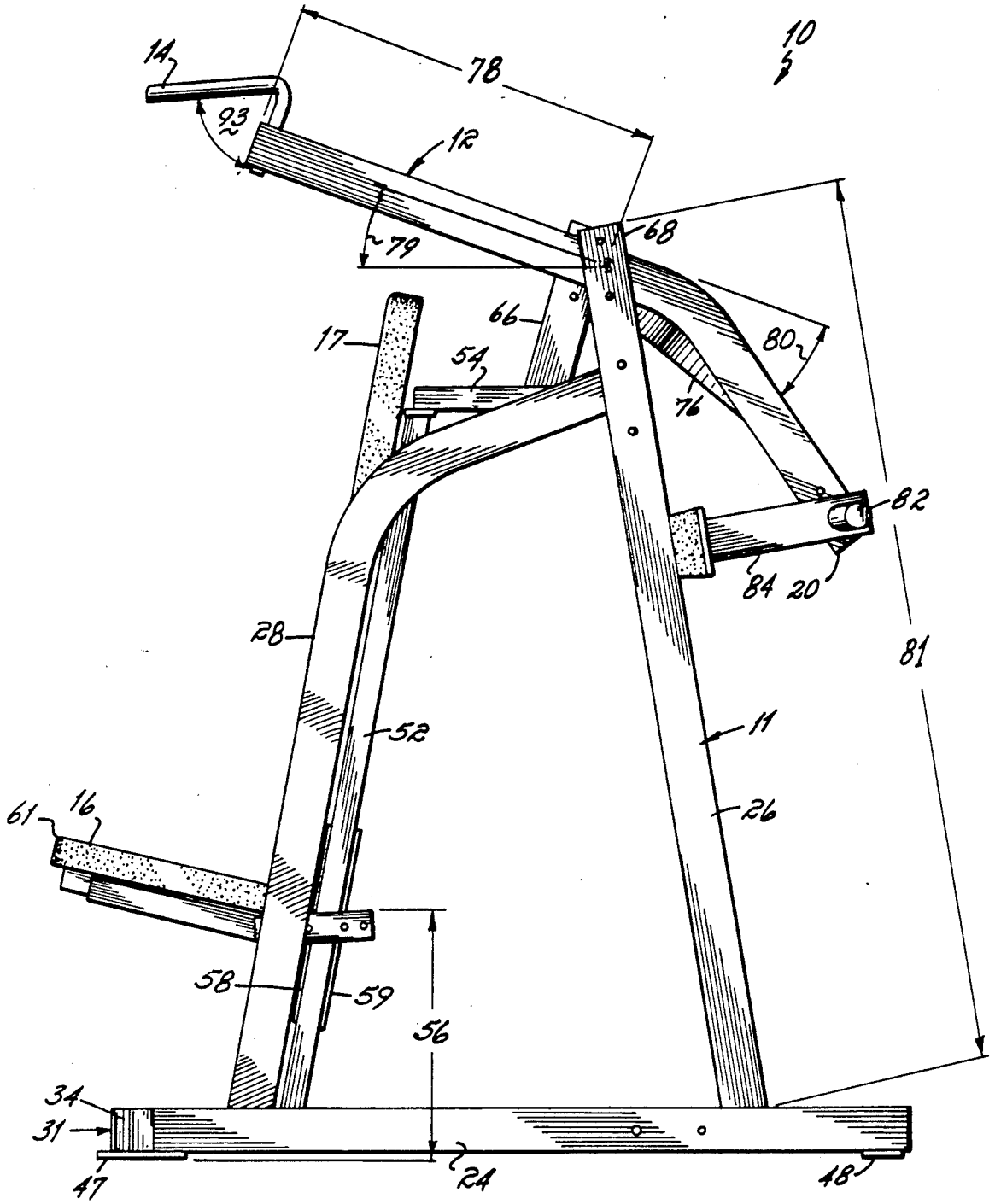
FIG. 4 is a side view of the pulldown exercise machine shown in FIG. 1.

FIG. 4 shows that the pivot points are approximately 51" above the vertical surface that supports the machine 10. This distance is designated by numeral 81. FIG. 4 also shows that length 78 of lever arm 12 is upwardly angled at about a 30° angle, an angle designated by numeral 79. Section 78 is about 26" in length. Handle 14 is upwardly angled with respect to the tip of section 78 at an angle of about 60°, numeral 93. In other words, it is offset from the angle of the length 78 by a downward angle of about 30°. The straight portion of the handle 14 is preferably about 7".

While I have described a preferred embodiment of this invention, it is to be understood that the invention is not limited thereby and that in light of the present disclosure of the invention, various other alternative embodiments will be apparent to a person skilled in the art. For instance, the structural orientation of some parts of the frame 11 is not critical, so long as the positioning of the seat 16 and support 17 with respect to the location of the pivot points and the lever arm and handle lengths and angles is maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A pulldown exercise machine comprising:

a frame;

a seat connected to the frame and adapted to support a person in a seated position straddling a first vertical plane;

a lever pivotally connected to the frame and adapted to be pivoted about an axis located behind and above said seat, the lever having a rearward end for holding a removable weight;

a handle connected to a forward end of the lever and adapted to be grasped and pulled in a downward direction by a person supported on said seat, said downward pulling motion pivoting said lever in an outer vertical plane that diverges from said first vertical plane.

2. The pulldown exercise machine of claim 1 and further comprising:

a second lever pivotally connected to the frame, the second lever being a mirror image of the first lever with respect to the first vertical plane and having a handle adapted to be grasped and pulled in a downward direction along a second outer vertical plane that also diverges from said first vertical plane.

3. The pulldown exercise machine of claim 1 wherein said handle extends from said second end in a downwardly and forwardly directed angle.

4. The pulldown exercise machine of claim 1 and further comprising:

stop means connected to said first end of said lever for coacting with said frame to limit pivotal movement of the lever with respect to the frame.

5. The pulldown exercise machine of claim 1 wherein said outer vertical plane diverges from said central vertical plane at an angle of about 5°.

6. The pulldown exercise machine of claim 5 wherein said lever forward end is angled upwardly from the horizontal at an angle of about 30°.

7. The pulldown exercise machine of claim 6 wherein said handle angles are offset inwardly from said lever at an angle of about 55°.

8. The pulldown exercise machine of claim 7 wherein said handle extends downwardly from the orientation of said lever by an angle of about 30°.

9. A pulldown exercise machine comprising:

a frame having two upright vertical sides that are mirror images of each other with respect to a central vertical plane, the sides aligned along outer vertical planes that both diverge from the central vertical plane with respect to a front of the frame;

a seat connected to the frame and adapted to support a person in a seated position straddling the central vertical plane;

two levers, each lever pivotally connected to a side of the frame and pivotal about an axis perpendicular to the outer vertical plane occupied by the respective side, each lever having a rearward end adapted to hold a removable weight; and two handles, each handle connected to a forward end of a lever and adapted to be grasped and pulled in a downward direction by a person supported in the seat to pivot the lever along the respective outer vertical plane against a predetermined weight resistance supported at said rearward end, thereby to provide simultaneous and/or independent pulldown exercise along said diverging planes.

10. The pulldown exercise machine of claim 9 wherein the axes of pivotal motion of the levers are each located above and behind the seat.

11. The pulldown exercise machine of claim 9 wherein each said handle is angled downwardly and inwardly in relation to the respective lever.

12. The pulldown exercise machine of claim 9 wherein each outer vertical plane is oriented outwardly at an angle of about 5° with respect to the central vertical plane.

13. The pulldown exercise machine of claim 9 wherein each lever further comprises:

stop means connected adjacent the rearward end and adapted to coact with the respective side of the frame to limit downward pivotal motion of said rearward end.

14. A pulldown exercise machine comprising:

a frame having a front and two sides that lie in planes which diverge outwardly from the front;

a seat connected to the frame and facing the front of the frame; and pulldown exercise means pivotally connected to each of the sides, each pulldown exercise means adapted to provide pulldown exercise against a selectable weight resistance and along a plane parallel to the respective side for a person supported on the seat.

15. The pulldown exercise machine of claim 14 wherein each said side diverges from said mid-plane at an angle of about 5°.

* * * * *